US006543516B2

(12) United States Patent
Hwang

(10) Patent No.: US 6,543,516 B2
(45) Date of Patent: Apr. 8, 2003

(54) UPPER BEAM STRUCTURE FOR ROMAN TYPE BLIND

(76) Inventor: Shiyang Hwang, No. 375, Gin Din Rd., San Min District, Kaohsiung City (TW)

( * ) Notice: Subject to any disclaimer, the term of this patent is extended or adjusted under 35 U.S.C. 154(b) by 0 days.

(21) Appl. No.: 09/892,734

(22) Filed: Jun. 28, 2001

(65) Prior Publication Data

US 2003/0000652 A1 Jan. 2, 2003

(51) Int. Cl.[7] ..... E06B 9/06
(52) U.S. Cl. ..... 160/84.01
(58) Field of Search ..... 160/84.01, 84.04, 160/84.05, 84.06, 243, 173 R

(56) References Cited

U.S. PATENT DOCUMENTS 2,247,260 A * 6/1941 Stone ..... 160/84.01
2,299,060 A * 10/1942 Sarran et al. ..... 160/84.01
3,439,725 A * 4/1969 Haimovitz et al. ..... 160/84.01
4,603,725 A * 8/1986 Knight ..... 160/243

* cited by examiner

*Primary Examiner*—David M. Purol
(74) *Attorney, Agent, or Firm*—Troxell Law Office PLLC

(57) ABSTRACT

An upper beam structure for a Roman type blind is made up of an upper beam, a pair of stuffing blocks, a hanging seat, a hanging retainer seat, a cloth curtain and two pull cords. The upper beam is a rectangular tube having a partitioned front receiving room and a rear receiving room axially extended the full length thereof. On a side wall or the bottom of the front receiving room and the bottom of the rear receiving room is disposed a longitudinal slot opening respectively via which the cloth curtain passes. The cloth curtain has an engagement retainer plate or block at the top edge thereof which can be easily guide into the front receiving room via the opened end. At the top of the rear receiving room of the upper beam is disposed a slot at each end, permitting pivot necks disposed at the top of a hanging seat and a hanging retainer seat to stick out thereof and hook members to be easily attached thereto externally in assembly. The pull cords of the cloth curtain can be easily held in place by a hanging retainer seat housed in the rear receiving room. Thereby the assembly of a blind can be simple, speedy and time saving.

5 Claims, 6 Drawing Sheets

UPPER BEAM STRUCTURE FOR ROMAN TYPE BLIND

BACKGROUND OF THE INVENTION

The present invention mainly relates to an upper beam structure for a Roman type blind. It is made up of an upper beam, a pair of stuffing blocks, a hanging seat, a hanging retainer seat, a cloth curtain and two pull cords. The upper beam is a rectangular tube having a partitioned front receiving room and a rear receiving room axially extended the full length thereof. On a side wall or the bottom of the front receiving room and the bottom of the rear receiving room is disposed a longitudinal slot opening respectively via which the cloth curtain passes. The cloth curtain is engaged with an engagement retainer plate or block at the top edge thereof which is placed and just housed in the front receiving room via the opened end with ease and speed. At the top of the rear receiving room of the upper beam is disposed a slot at each end so as to permit pivot necks disposed at the top of a hanging seat and a hanging retainer seat to stick out thereof and hook member to be easily attached thereto from outside in assembly. The pull cords of the cloth curtain can be easily held in place by a hanging retainer seat housed in the rear receiving room. Thereby the assembly of a blind can be simple, speedy and time saving.

Generally, the Roman type blind 10 for indoor use, as shown in FIG. 1, is comprised of an upper beam 11 of a proper length and a rectangular cloth curtain 12 whose upper edge is wound around and sewn in a way to engage with the upper beam 11 and further fixed in place by rivets at both ends of the upper beam 11 so as to permit the cloth curtain 12 to naturally drape down. At an equal distance of the cloth curtain are disposed a folded rib 121. Positioning rings are sewn to the rear side of the top and bottom folded ribs 121. A hanging device 13 is secured at each end of the upper beam 11. Each hanging device 13 is provided with a pivot hook 131 so as to permit the Roman type blind 10 to be attached to nails affixed to a wall above a window. At each end of the upper beam 11 are disposed a pair of pull cords 14 (only one pair of cords shown in FIG. 1). At the bottom end of the pull cords 14 is respectively disposed a cap 141. The pull cords are engaged with the positioning rings so that the pull of the pull cords permits the piling collection of the cloth curtain 12 and the pull cords 14 can be held in place by a retaining device b disposed next to the blind.

Such a prior art structure has the following disadvantages in use:

1. The cloth curtain 12 is engaged with the upper beam 11 in a rather tedious and complex manner by sewing and riveting.
2. The hanging devices 13 are fixed to each end of the upper beam 11 by screws, and the fixing of the hanging device 13 to the upper beam 11 is troublesome and time consuming.
3. The pull cords 14 are not fixed in place when the cloth curtain 12 is collected, only the retaining device b is used to hold the pull cords 14 which are wound around the retaining device b; it is relatively inconvenient, difficult, time consuming and not secure enough.

SUMMARY OF THE INVENTION

Therefore, the primary object of the present invention to provide an improved upper beam structure which permit a cloth curtain of a Roman type blind to be easily, quickly engaged with the upper beam so as to make the assembly in a time saving manner, resulting in the reduction of production cost and increase of competition.

Another object of the present invention is to provide an upper beam structure for a Roman type blind wherein hanging devices can be easily mounted to and secured to the upper beam without using any assistant tools so as to make the mounting of the upper beam in an easy and speedy manner.

One further object of the present invention is to provide an upper beam structure for a Roman type blind wherein pull cords of the blind can be quickly and securely retained in position by a hanging retainer seat, permitting the cloth curtain to be conveniently and smoothly collected without using any additional retaining means, making the outer appearance appealing to eyes.

DETAILED DESCRIPTION OF THE PREFERRED EMBODIMENTS

Figure 1:
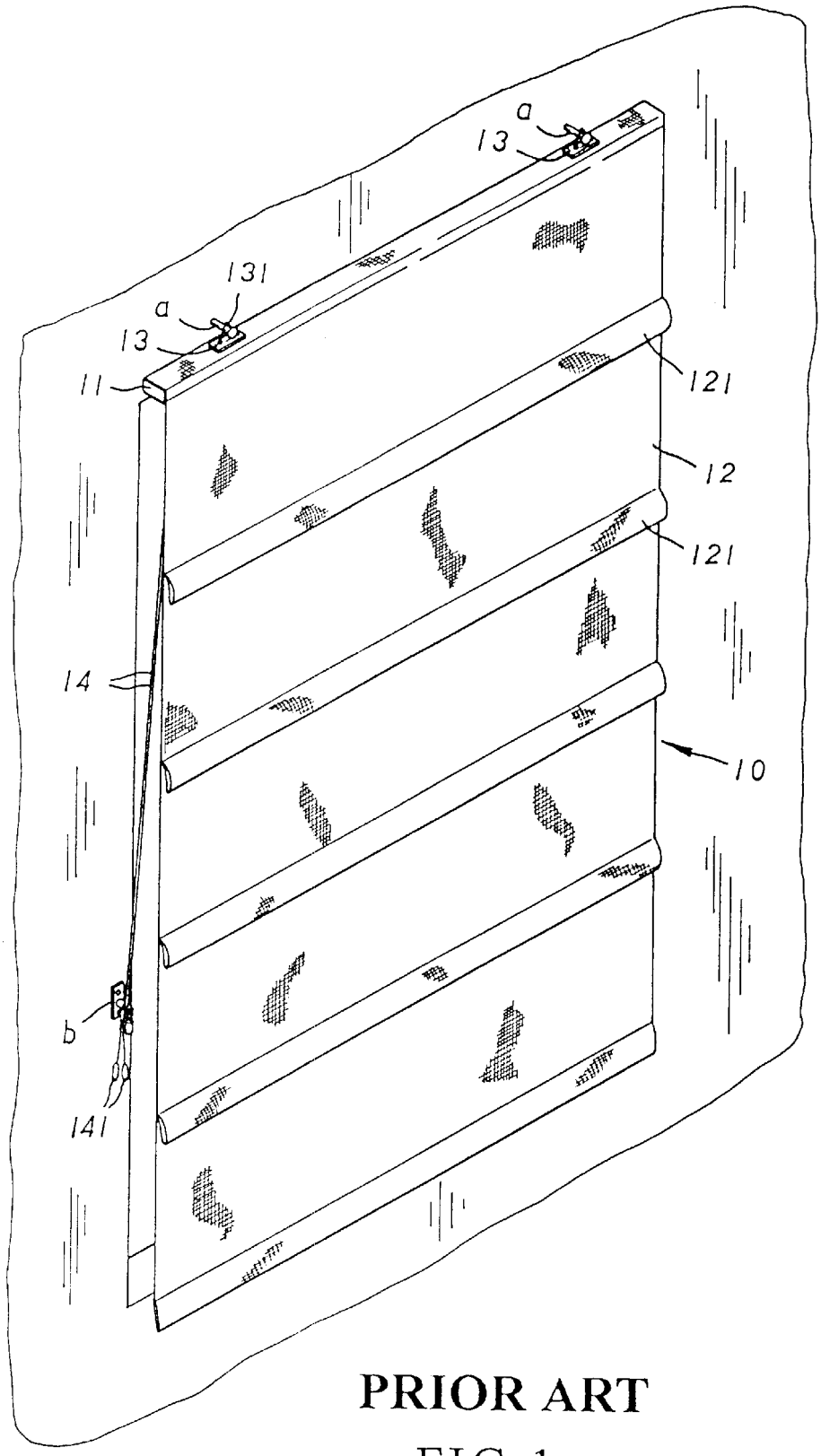
PRIOR ART FIG.1
FIG. 1 is a perspective diagram showing the conventional Roman type blind structure.
Figure 2:
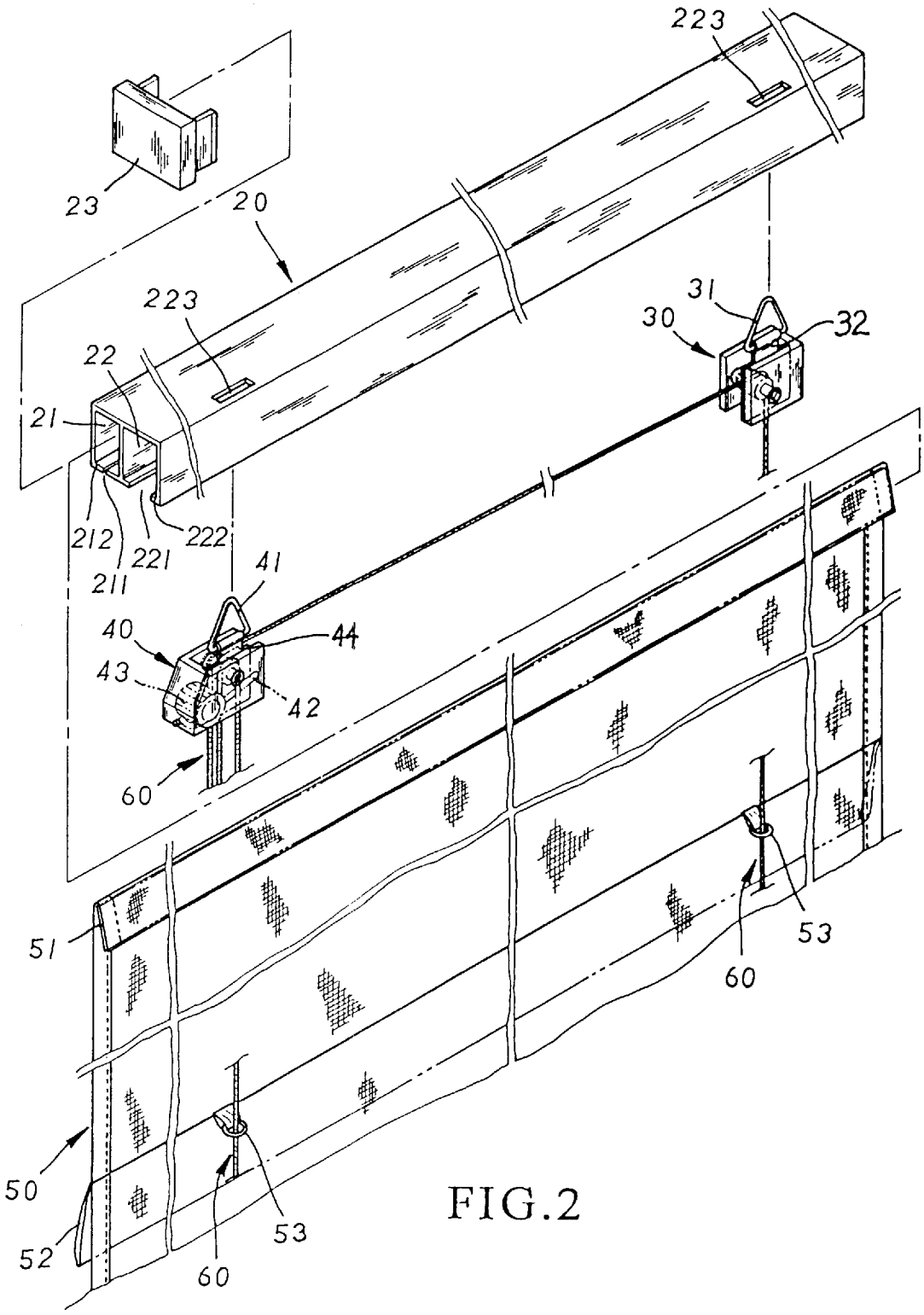
FIG. 2 is a perspective diagram showing the exploded components of the present invention.

Referring to FIG. 2, the Roman type blind is mainly comprised of an upper beam 20, a pair of stuffing blocks 23, a hanging seat 30, a hanging retainer seat 40, a cloth curtain 50 and two pull cords 60. The upper beam 20 is a tube of proper length and has a longitudinally extended and partitioned front and rear receiving rooms 21, 22 which have a slot opening 211, 221 axially extended the full length thereof with an inwardly bent flange 212, 222 respectively. On the ceiling of the rear receiving room 22 is disposed a slot 223 at each end thereof. The hanging seat 30 is a C-shaped form having a front and rear wall with a supporting rod disposed therebetween for connection. A pivot neck 32 engaged with a hook member 31 is disposed on the rear wall of the hanging seat. The hanging retainer seat 40 has a front and rear wall connected end to end with a supporting rod disposed therebetween. On the rear wall is disposed a pivot neck 44 with a hanging hook 41 attached thereto and between the walls and next to the supporting rod is disposed a positioning roller gear 43. A limiting stick 42 is located in the space between the two walls and near a bottom thereof.

The cloth curtain 50 is a piece of rectangular cloth of proper width with a engagement retainer plate 51 secured to the top edge thereof. The engagement retainer plate 51 is smaller in dimension of the front receiving room 21 and the thickness is slightly larger than the slot opening 211 at the bottom of the front receiving room 21. At equal distance from the top to the bottom edge of the cloth curtain 50 are disposed a plurality of folded and sewn drape pieces 52 which drape down naturally. On the back side of the top and bottom drape pieces 52 and in alignment with the two slots 23 of the upper beam 20 are disposed positioning rings 53.

Figure 3:
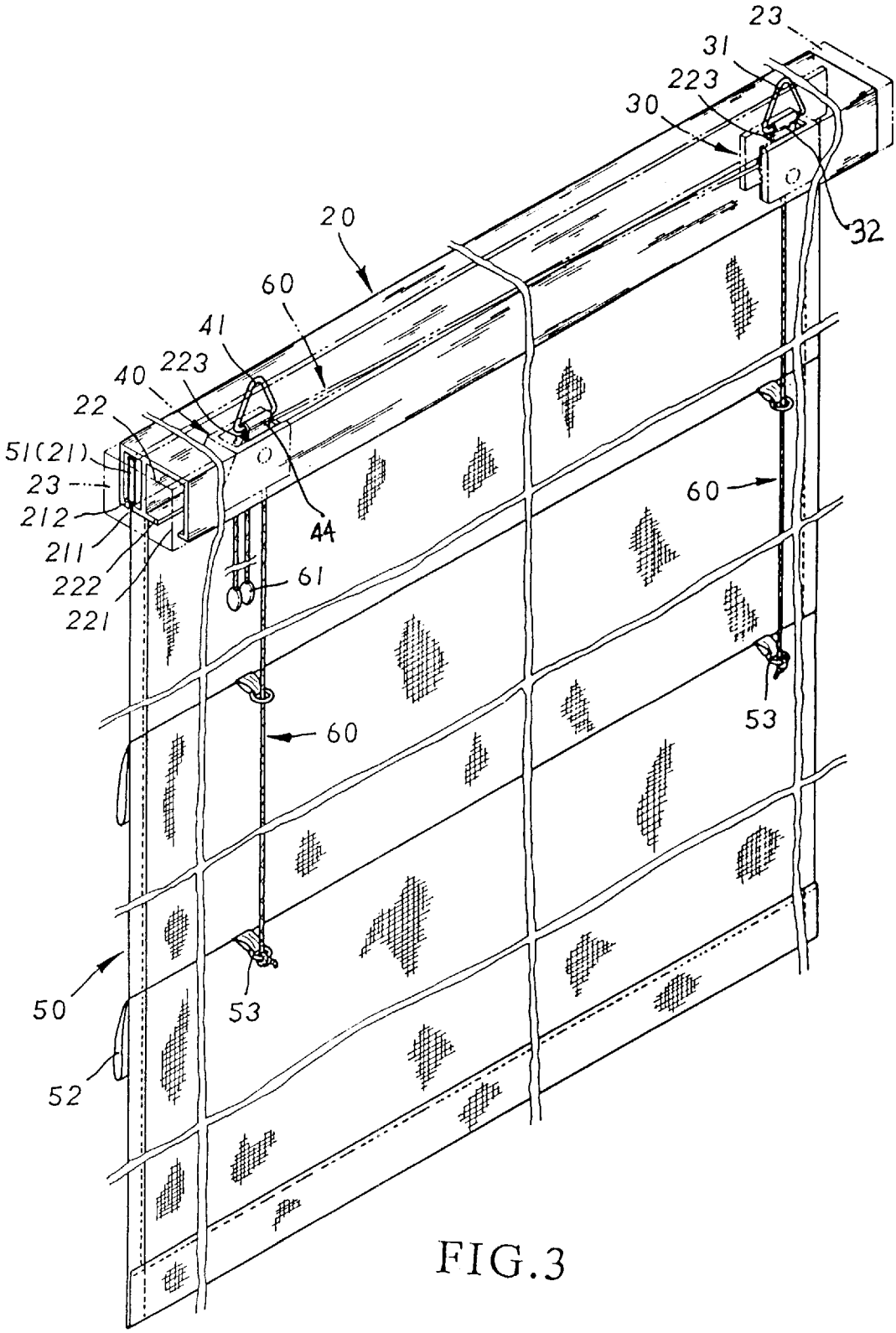
FIG. 3 is a perspective diagram showing the assembly of the present invention.
Figure 4:
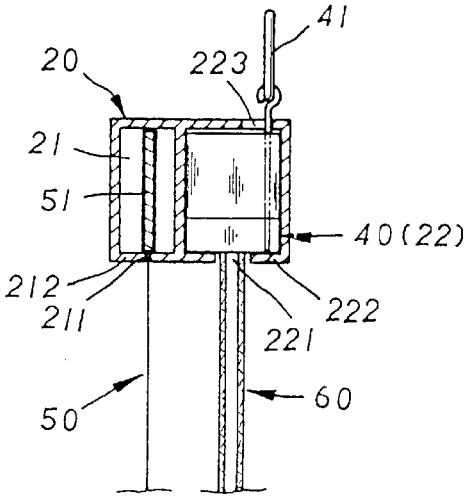
FIG. 4 is a sectional diagram showing the upper beam in engagement with the engagement retainer plate of the cloth curtain in assembly.

In assembly, as shown in FIGS. 3, 4, the hanging seat 30 and the hanging retainer seat 40 are first located into the rear receiving room 22 of the upper beam 20 from the respective opened end. Then the hanging seat 30 and the hanging retainer seat 40 are located under the respective slot 223 of the upper beam 20 with the pivot neck portions thereof projected out of the slots 223 so as to permit the hook members 31, 41 to be externally engaged with the hanging seat 30 and the hanging retainer seat 40 respectively, resulting in the fixing of the hanging seat 30 and the hanging retainer seat 40 individually in the rear receiving room 22 of the upper beam 20. Afterwards, the engagement retainer plate 51 disposed at the top edge of the cloth curtain 50 is fully led into the front receiving room 21 of the upper beam 20 with ease and speed from the opened end thereof so as to permit the cloth curtain 50 to drape naturally downwardly under the slot opening 211. The stuffing blocks 23 are respectively attached to each open end of the upper beam 20.

Figure 5:
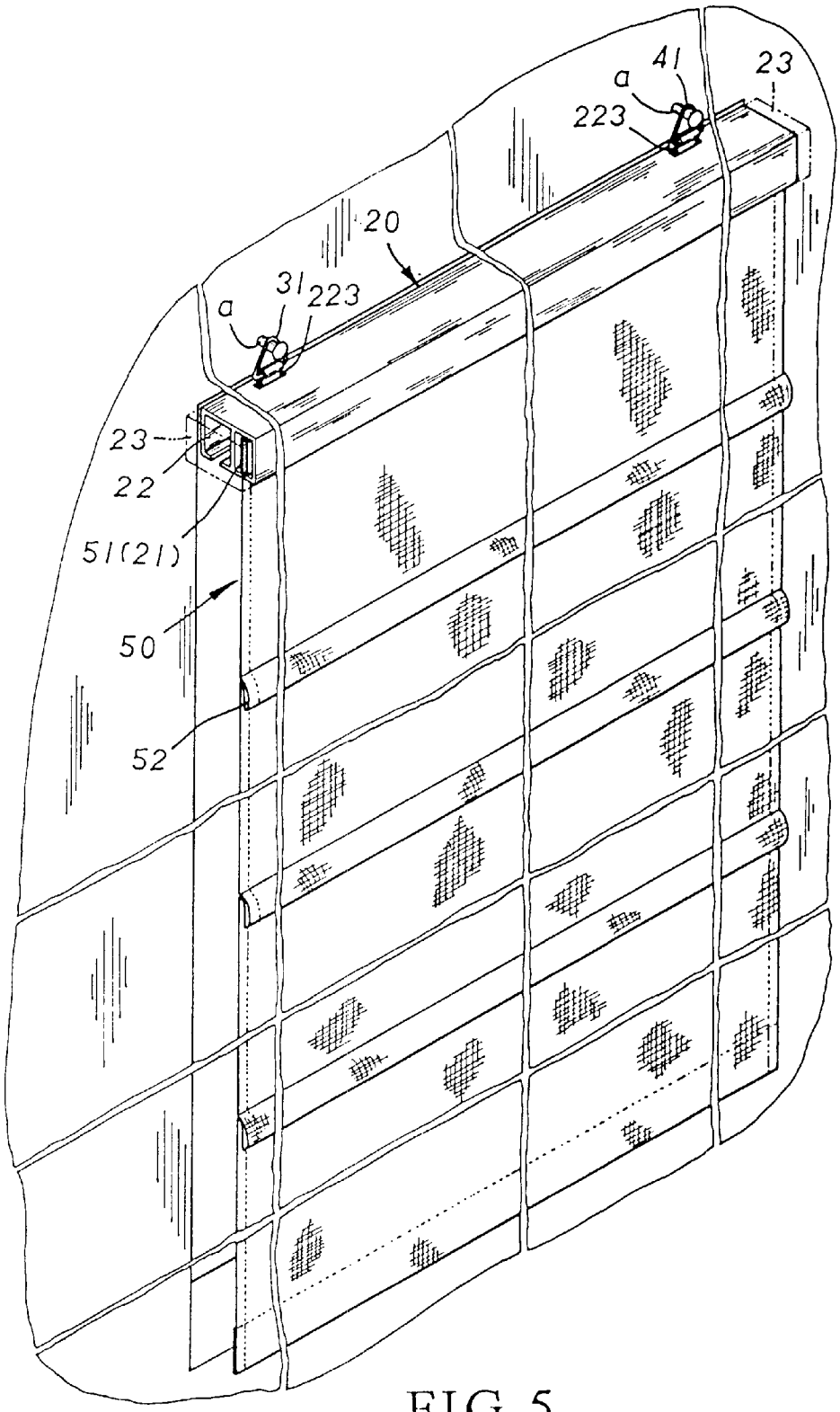
FIG. 5 is a diagram showing the hanging state of the present invention.

The bottom ends of the two pull cords 60 are respectively fixed to the positioning rings 53 disposed at each end of the bottom drape piece 52 of the cloth curtain 50; and the top ends of the pull cords 60 are led upwardly through the respective positioning rings 53 disposed at the top drape piece 52 of the cloth curtain 50 and further guided into and wound in the hanging seat 30 and the hanging retaining seat 40 individually. Afterwards, they are commonly led into the hanging retainer seat 40 and out of the same from the bottom thereof to form a pull handle 61 to complete the assembly of the Roman type blind. Then, the blind can be secured to nails fixed to the wall area above the upper beam 20, as shown in FIG. 5, by way of the hook members 31, 41 of the hanging seat 30 and the hanging retainer seat 40. Thereby, the hand actuation of the pull handle 61 of the pull cords 60 can cause the positioning roller gear 43 to shift into locking engagement with the limiting stick 42 so as to hold the pull cords 60 in position with ease, readiness and precision after the cloth curtain 50 is collected.

Figure 6:
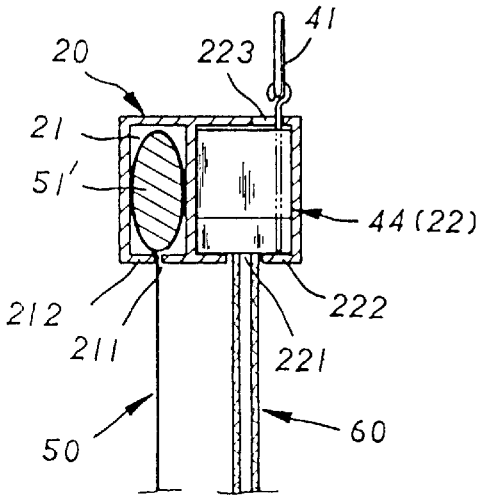
FIG. 6 is a sectional diagram showing the use of another engagement retainer block of the cloth curtain of the present invention.

Moreover, referring to FIG. 6, in a second embodiment of the present invention, the engagement retainer plate 51 is replaced with the engagement retainer block 51' which is of an oval shaped cross section and is only slightly smaller than the space of the front receiving room 21 of the upper beam 20 so as to permit the retainer block 51' to be easily, quickly and securely located in the front receiving room 21 without detachment.

Figure 8:
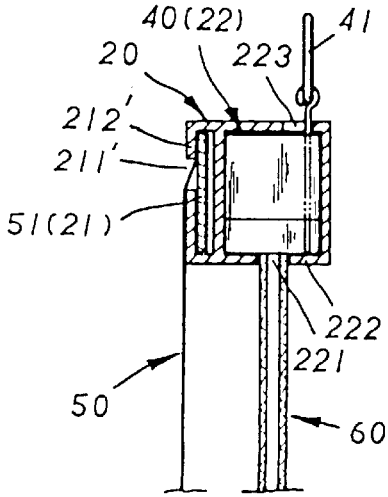
FIG. 8 is a sectional diagram showing the engagement of the second type upper beam with a engagement retainer plate of the cloth curtain.
Figure 7:
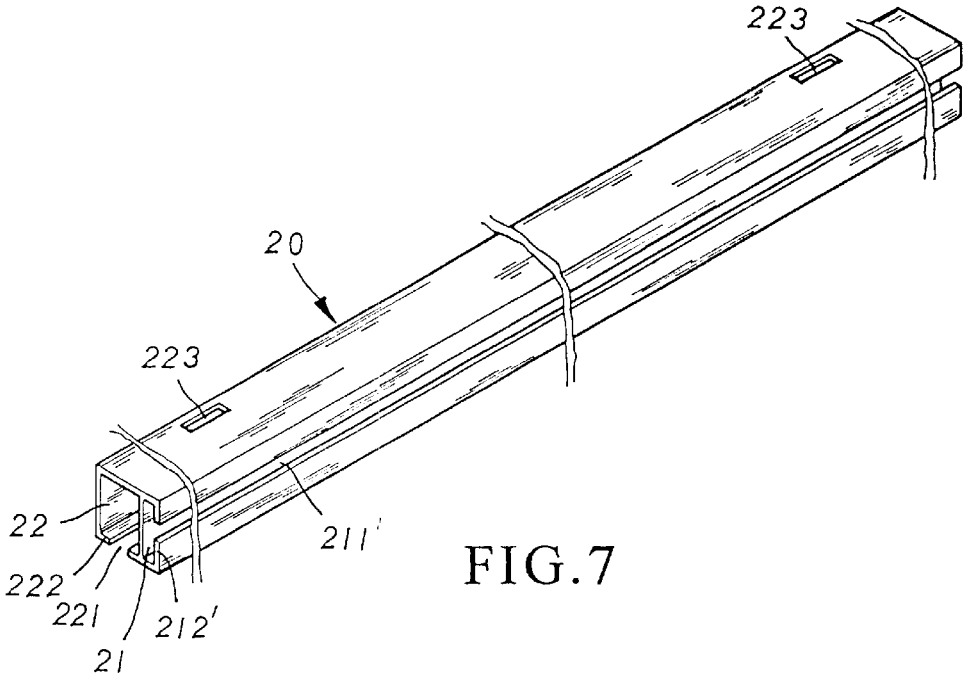
FIG. 7 is a second embodiment of the upper beam structure.
Figure 9:
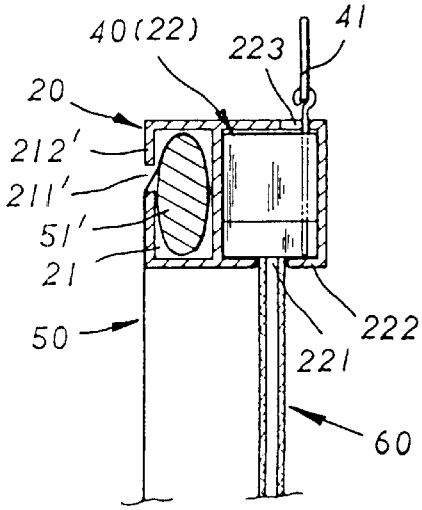
FIG. 9 is a sectional diagram showing a third upper beam structure in engagement with another engagement retainer block of the cloth curtain.

In addition, the slot opening 211 disposed at the bottom of the front receiving room 21 of the upper beam 20 can be replaced by another front side slot opening 211' disposed at the front wall of the front receiving room with a vertical flange 212' above the front side slot opening 211', as shown in FIGS. 7–9. Accordingly, the engagement retainer plate 51 or the engagement retainer block 51' can be put into the respective front receiving rooms 21 of various sizes which are just slightly larger than the dimension of the engagement retainer plate 51 or block 51' so that they can be firmly and securely retained in the front receiving room 21 after the engagement retainer plate 51 or block 51' is guided into the front receiving room 21 from the side opened end of the upper beam 20 with ease and speed with the cloth curtain 50 passing via the front side slot opening 211' of the front receiving room 21. It can effect the same functional purpose.

From the preceding description of the embodiments, the following advantages can be apparently seen:

1. The cloth curtain 50 is engaged with the upper beam 20 simply by way of the engagement retainer plate 51 or block 51' which are led easily and quickly into the upper beam 20 from one side opened end with the cloth curtain 50 passing via the bottom slot opening 211 or side slot opening 211', making the assembly and mounting easy, speedy and time consuming.
2. The hanging seat 30 and the hanging retainer seat 40 are guided into the upper beam 20 from both ends and are located easily and precisely in position by sticking the pivotal necks with the hooks 31, 41 out of the slots 223 defined at the top surface of the rear receiving room 21 of the upper beam 20.
3. The cloth curtain 50 can be easily collected and the pull cords 60 are easily held in place by way of the hanging retainer seat 40 in the upper beam without using an addition retaining means secured to a wall section next to the blind, making the mounting easy and the external appearance appealing to eyes.

I claim:

1. An upper beam structure for a Roman type blind, comprising: an elongated tubular upper beam having a partition between a front receiving room and a rear receiving room, the rooms axially extending along a full length of the beam; longitudinal slots on a wall of said front receiving room and a bottom of said rear receiving room and top slots at a top of said rear receiving room; a cloth curtain having an engagement retainer at a top edge thereof, the engagement retainer housed in said front receiving room and the cloth curtain extending through the longitudinal slot in said front receiving room; a hanging seat and a hanging retainer in the rear receiving room, each having a pivot neck extending out of said top slots, the pivot necks configured to receive hook members therein; cords engaging said cloth curtain, said retainer seat and said hanging retainer, the pull cords being held in place by said hanging retainer seat housed in said rear receiving room and including a pull handle section; and a stuffing block mounted in each opposite end of the upper beam.

2. The upper beam structure for a Roman type blind as claimed in claim 1 wherein said engagement retainer secured to the top edge of said cloth curtain is a plate in said front receiving room of said upper beam to mount said cloth curtain hanging in said upper beam.

3. The upper beam structure for a Roman type blind as claimed in claim 1 wherein said engagement retainer secured to the top edge of said cloth curtain is a block in said front receiving room of said upper beam to mount said cloth curtain hanging in said upper beam.

4. The upper beam structure for a Roman type blind as claimed in claim 1 wherein said longitudinal slot of said front receiving room is disposed in a bottom wall thereof.

5. The upper beam structure for a Roman type blind as claimed in claim 1 wherein said longitudinal slot of said front receiving room is disposed in a front side wall thereof.

* * * * *